US007802529B2

(12) United States Patent
Shen et al.

(10) Patent No.: US 7,802,529 B2
(45) Date of Patent: Sep. 28, 2010

(54) CARPET PRIMARY BACKING MATERIAL

(75) Inventors: ChangQing Shen, Lakewood, CO (US); Lester M. Aseere, Parker, CO (US)

(73) Assignee: Johns Manville, Denver, CO (US)

( * ) Notice: Subject to any disclaimer, the term of this patent is extended or adjusted under 35 U.S.C. 154(b) by 1170 days.

(21) Appl. No.: 11/434,944

(22) Filed: May 16, 2006

(65) Prior Publication Data

US 2007/0266534 A1 Nov. 22, 2007

(51) Int. Cl.
*D05C 15/00* (2006.01)
*D04H 3/12* (2006.01)
*D04H 1/58* (2006.01)

(52) U.S. Cl. ..... 112/475.08; 28/112; 428/95

(58) Field of Classification Search ..... 112/475.01, 112/475.08, 475.23, 410; 28/108, 109, 112; 442/320–327; 428/85, 95–97, 137
See application file for complete search history.

(56) References Cited

U.S. PATENT DOCUMENTS 2,213,296 A * 9/1940 Zinser ..... 428/162
3,264,167 A * 8/1966 Seymour ..... 428/133
3,867,188 A * 2/1975 Campbell et al. ..... 442/99
4,112,161 A * 9/1978 Sorrells ..... 428/95
6,217,974 B1 * 4/2001 Pacione ..... 428/95
7,279,214 B2 * 10/2007 Nicolai et al. ..... 428/137
2005/0130536 A1 * 6/2005 Siebers et al. ..... 442/327
2006/0099380 A1 * 5/2006 Vollmert et al. ..... 428/92

* cited by examiner

*Primary Examiner*—Ismael Izaguirre
(74) *Attorney, Agent, or Firm*—Robert D. Touslee

(57) ABSTRACT

A process is described for treating a nonwoven fabric to improve the gripping ability of the fabric during the preparation of tufted carpets. The process includes the steps of applying an elastomeric binder to the fabric, treating the fabric to provide a series of depressions or holes in a pattern consistent with the tufting needle pattern to be subsequently applied, and then curing the binder. The resultant fabric has a pattern of holes or depressions which are essentially free of binder with excess binder squeezed from the depressions forming rings around the depressions. When the tufting needle is inserted into the depression or hole, the elastomeric ring surrounding the hole expands. Upon retraction of the needle, the elastomeric ring contracts and exerts a firm grip on the tuft in the hole.

15 Claims, 1 Drawing Sheet

CARPET PRIMARY BACKING MATERIAL

BACKGROUND

1. Field of the Invention

The present invention relates to a process of treating a nonwoven web with an elastomeric binder. More particularly the invention relates to treating a spunbonded polyester web to impart improved tufting properties.

2. Description of Related Art

A tufted carpet is generally manufactured by inserting reciprocating needles threaded with a face yarn through a primary backing material to form loops or tufts of yarn in the backing. The quality, appearance and dimensional stability of tufted carpets depends in large part on the properties of the primary backing.

Primary backings are usually produced from woven or nonwoven materials. Tufting into nonwoven materials is more difficult than tufting into woven materials. A woven fabric will open within the weave to accept the tufting needle and yarn and will then close around the tufted yarn after the needle has retracted. The closing property of woven fabrics provides a firm grip on the yarn in the opening. The yarn must remain in the opening until adhesive is applied to secure the yarn in place.

On the other hand, nonwovens have no weave to open and close nor do the individual filaments have a memory to return to the original state. Tufting into a nonwoven backing usually results in creating an opening large enough to accept the tufting needle and yarn. However, when the needle retracts, the opening does not close tightly around the yarn and remains larger than necessary to grip the yarn. The result is a condition in which the tufting yarn may slip out of the opening creating defects and necessitating repair and reworking.

Nonwoven backing materials typically are spunbonded or spunlaid webs formed from thermoplastic polymers such as polyolefins, polyesters and blends of these materials. Spunbonding is a process which generally involves feeding a thermoplastic polymer into an extruder, feeding the extruded molten polymer through a spinneret to form continuous filaments, and laying down the extruded filaments on a moving conveyor belt to form a nonwoven web of randomly arranged continuous filaments. In the lay-down process, desired orientation may be imparted to the filaments by various means such as rotation of the spinneret, electrical charges, introduction of controlled airstreams, varying the speed of the conveyor belt, etc. The individual entangled filaments in the nonwoven web are then bonded primarily at filament cross-over points by thermal or chemical or mechanical treatments. The spunbonded web is then wound up in a roll form.

During the carpet tufting process, hundreds of tufting needles threaded with yarn are inserted into the primary backing material with each stroke of the needle bar. Each needle penetrates the backing material creating an opening and then retracts leaving a loop of yarn in each opening. Each needle then moves to the next insertion point.

During the tufting process, the primary backing material must provide two very important characteristics: insertion resistance to the tufting needles and the ability to grip and hold the yarn loop (tuft) in place after the needles retract. Optimally, it would be most desirable to have a backing material which has minimal insertion resistance and maximum tuft grip at any point. However, mechanical and chemical properties of the web material necessitate a designed trade-off of both characteristics. That is to say, a high gripping force would likely require a high penetration force. Conversely, a low penetration force usually results in a poor or weak tuft gripping force. A primary backing which combines a low insertion resistance with a high gripping force would be highly desirable.

It is an object of the invention to produce a nonwoven web suitable for use as a carpet backing material which has improved tuft gripping characteristics.

Another object of the invention is a process for improving the tuft gripping properties of a spunbonded or spunlaid polyester fabric.

Still another object of the invention is an improved process of producing a tufted carpet.

These and other objectives of the present invention will become readily apparent upon a review of the present disclosure.

SUMMARY OF THE INVENTION

In order to attain the above objectives, a method has now been devised which includes the steps of applying a curable, elastomeric binder formulation to a nonwoven web, treating the web to provide a series of voids or depressions in the web that are in register with the tufting needle pattern to be subsequently applied, and heating to cure the elastomeric binder. The treated nonwoven web may then be wound up into rolls for future processing.

DETAILED DESCRIPTION OF PREFERRED EMBODIMENTS

Figure 1:
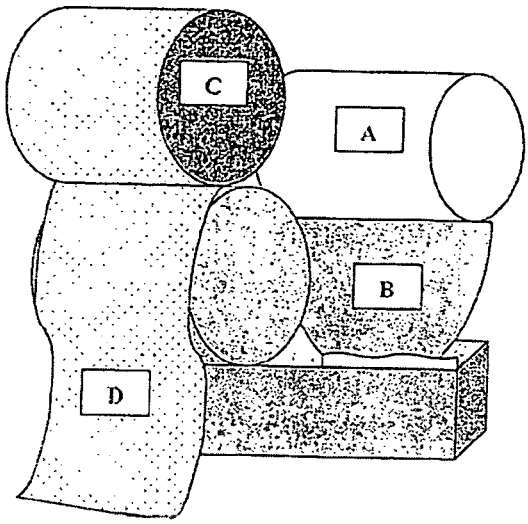
FIG. 1 is a diagrammatic representation of a process of the invention.

Suitable nonwoven webs to be processed in accordance with the present invention include those prepared from thermoplastic polymers such as polyolefins, polyesters, polyamides and blends of these polymers. Nonwovens derived from polyesters are preferred and spunbonded or spunlaid polyester webs are particularly preferred. The nonwoven webs can be prepared using conventional methods and include dry-laid, wet-laid, spunlaid, melt-blown, spunbonded and spunlaced products.

Preferably, the nonwoven web is needled, heat-set and calendered before treatment with an elastomeric binder. Needling or needle-punching through the thickness of the nonwoven web creates fiber entanglement in the "Z" direction (i.e., through the thickness of the fabric) in addition to the normal thermal bonding in the "X" and "Y" direction (i.e., in the machine direction and cross-machine direction). The needling provides fiber bonding and entanglement in all directions, thereby increasing the opportunities for entanglement with the tufted yarn. Needling also provides additional loft to the fabric which results in a slightly thicker material for the same fabric weight and provides an additional grip on the tuft. The nonwoven web may be needled in one or both directions. Also, custom needling may be performed in a conventional manner to create patterns or grains in the web.

Needling (or needle-punching) can be performed using any commercially available needling apparatus. As is well known, the degree of needling affects the tensile strength of the web or fabric. The number of needle penetrations per square inch should be selected for optimum intermingling and entanglement of the individual filaments of the web.

Alternatively, fiber entanglement could be accomplished by other well-known techniques. These would include hydro-entangling using high pressure water jets instead of barbed needles.

The nonwoven web preferably is heat-set. This step improves dimensional stability and locks in the loft provided by a needle-punching step. The improved loft aids in reducing compression upon any subsequent calendering, and also pre-shrinks the web before locking in memory, thereby minimizing stretching or shrinking of the web which may occur during subsequent processing.

Operable heat-setting temperatures will depend in large part upon the nature of the polymer used to prepare the nonwoven web. Temperatures must be selected which are high enough to effect heat-setting but below the melting or decomposition temperatures of the polymeric materials. For spunbonded or spunlaid polyester nonwovens, a temperature range of about 190° C. to about 250° C. is preferred. A temperature of about 205°-210° C. is most preferred.

Any suitable heating apparatus can be employed. Drum ovens are particularly suitable. Heat-setting can be accomplished by exposing the web to pressurized saturated steam or by employing apparatus which provides dry heat.

The nonwoven web preferably is calendered after heat-setting by treating at temperatures and pressures sufficient to bond surface filaments and compact the web to a suitable thickness for further processing. Calendering may also be used to provide a smooth surface to the web, if desired. The temperature and pressure can be adjusted to provide a suitable thickness and surface texture to the web. Because the web was previously heat-set, the loft is unaffected and internal fiber entanglement is undisturbed.

The temperature and pressure conditions generally suitable for calendering range from about 100° C. to about 250° C. and from atmospheric up to about 500 lbs/in$^2$. Conventional calender rolls or cylinders can be employed in the calendering process.

Preferably, the fabric is cooled after calendering, most preferably to room temperature. Cooling is believed to help set dimensional memory in the fabric. Cooling can be accomplished by air cooling or cooling jets or any conventional cooling means.

It is an important feature of the process of the invention to provide elastomeric properties to the web or fabric. This is accomplished by contacting the web with a liquid, curable, elastomeric binder formulation.

The elastomeric binder provides the fabric with an elastomeric property which enables the opening made with the tufting needle to shrink in size after the needle retracts. Shrinking of the opening after needle retraction increases the gripping action on the yarn tuft. The elastic nature of the binder also allows for multiple repairs of the fabric if the tuft yarn is removed from the opening for various reasons. In many backing fabrics, the piece of material between needle openings will tear when repairs are necessary. The elastic properties of nonwoven fabrics processed according to the invention allow the piece of material between needle openings to expand and stretch without tearing, thereby facilitating repairs.

Suitable elastomeric binder formulations include water-based and organic solvent-based elastomers containing conventional curatives and additions. Latexes are preferred for environmental reasons. Examples include curable polyurethanes, homopolymers and copolymers of dienes such as butadiene/styrene rubbers, acrylics, etc.

Conventional additives may be present in the elastomeric formulations. These additives include curing agents and curing adjuvants, fillers, lubricants, colorants, anti-microbials, water resists, etc. The amount of elastomeric binder and the solids content of the formulation can be adjusted for optimum performance. Generally, the solids content will range from about 10% to about 30% by weight, preferably about 15% to about 25%.

Conventional means may be employed to apply the binder to the web. Bath immersion, spraying or roller coating may be employed. Preferably, the nonwoven web is fully saturated by the elastomeric formulation. This can be accomplished by immersing the web in a dip tank containing the elastomeric binder.

After impregnating with the elastomeric binder, the web preferably is processed to remove excess binder. Simultaneous or subsequent to excess binder removal, the web is provided with holes, voids or depressions. The holes, voids or depressions are in a pattern consistent with, and in register with, the tufting needle pattern to be used when the finished web is subsequently tufted in a future carpet manufacturing operation. Preferably, the removal of excess binder and the application of holes or voids in the web occur simultaneously, for example, by feeding the web through a set of rollers, one having a smooth face and the other having a surface with raised protrusions of a predetermined height, size and pattern.

Any commercially available embossing apparatus may be employed to apply the voids (dimples), holes or depressions. Engraved heated rollers are particularly suitable.

The effect of this step is to provide a nonwoven web having little or no binder in the holes or depressions and having a hole which is smaller than the tufting needle containing the face yarn. Energy created when the hole is stretched during the tufting operation is, in effect, stored in the elastic binder which has been squeezed from the depression and surrounds the hole. When the needle retracts, the stored energy is released causing the stretched fabric around the hole to relax and hold the tuft firmly in place.

Following the treatment to apply voids or holes in the binder-treated fabric, the binder is allowed to cure. Preferably, the treated fabric is routed over drum heaters at a temperature high enough to dry the fabric and cure the binder without softening the fibers or changing the heat-set of the fibers. The drying and curing operation provides additional bonding at filament junctions and endows the fabric with elastomeric properties. A range of suitable temperatures for nonwoven polyesters for drying/curing is 100 ° C. to about 250 ° C.

The finished product is then wound up in rolls. Preferably, winding apparatus is used which is designed to drive the take-up roll at the core. Friction wheel winders may slip on a lubricated surface of the fabric and create poor packing on the roll. Core driven winders will pull the wraps tighter resulting in a much more stable package.

EXAMPLE

With reference to FIG. 1, a base material A, which is a spunlaid nonwoven polyester, is threaded through a binder dip tank B containing a curable, liquid, elastomeric formulation. The base material, fully saturated with binder, is then threaded through a pair of squeeze rollers where pressure is set to remove a specific and predetermined amount of binder. One roller C has a surface with raised protrusions of a predetermined height, size and pattern consistent with and in register with the desired hole pattern on the finished web D. The web D is then heated to dry the material and cure the binder.

Figure 2:
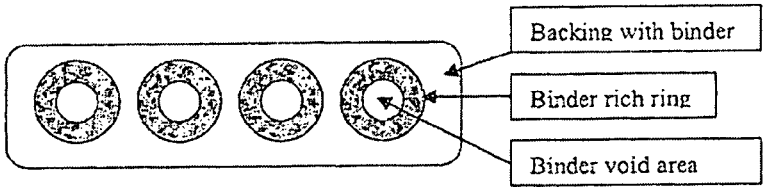
FIG. 2 is a view of depressions or holes in a web treated in accordance with the present invention.
Figure 3:
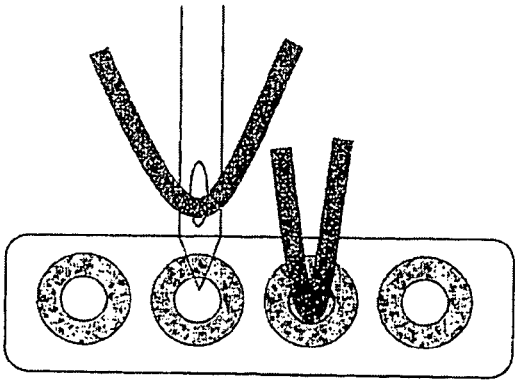
FIG. 3 is a view of a tufting procedure on a web prepared by the process of the present invention.

As shown in FIG. 2, the protrusions on the surface of roller C effectively squeeze most or all of the binder from the voids or depressions beneath them and push excess binder into a ring pattern surrounding the hole or void. The result is a dimple essentially free of binder having a binder-rich ring around the void. This ring has the capacity to store the energy created during tufting by expanding in a manner similar to a rubber band when the needle is inserted into the hole or void. When the needle retracts, leaving the tuft in the hole, the stored energy is released, the ring relaxes and tightly grips the tuft. This is shown in FIG. 3. The result is a superior grip on the yarn tuft that reduces defects, reworking and waste while providing a consistent yarn pattern on the show surface of the carpet.

Having described preferred embodiments of the invention, it is to be understood that the invention is not limited to those precise embodiments, and that various changes and modifications may be effected therein by one skilled in the art without departing from the scope or spirit.

The invention claimed is:

1. A process for preparing a tuftable nonwoven fabric which comprises the steps of:

(a) applying a curable elastomeric binder formulation to a nonwoven web;

(b) providing the nonwoven web with a series of holes or depressions, the holes or depressions being in a pattern which is in register with a pattern of tufting needles to be subsequently applied to the web; and curing the elastomeric binder.

2. The process of claim 1, wherein the holes or depressions are imparted by an embossed roller.

3. The process of claim 1, wherein step (b) is performed by passing the web through a pair of rollers, one roller having a smooth surface and the other having a surface with raised protrusions.

4. The process of claim 1, wherein the nonwoven web is treated to provide fiber entanglement throughout the thickness of the web and is heat-set before applying the elastomeric binder.

5. The process of claim 1, wherein the nonwoven web is needle-punched, heat-set and calendered before application of the elastomeric binder.

6. The process of claim 1, wherein the nonwoven web is prepared by a dry-laid, wet-laid, spunlaid, melt-blown, spunbonded or spunlaced process.

7. The process of claim 1, wherein the nonwoven web is a spunbonded or spunlaid polyester.

8. The process of claim 5, wherein the web is needled in both directions.

9. The process of claim 4, wherein the web is a nonwoven polyester fabric and is heat-set at a temperature of about 205°-210° C.

10. The process of claim 1, wherein the elastomeric binder comprises a diene polymer, a polyurethane or an acrylic latex.

11. The process of claim 1, wherein the web is saturated with the binder and excess binder is removed simultaneously with providing holes or depressions.

12. The process of claim 1, wherein the web is heated to effect curing and drying.

13. A process of preparing a tufted carpet backing which comprises the following steps:

(a) applying a curable elastomeric binder to a nonwoven web;

(b) contacting the nonwoven web with a surface having raised projections to impart a series of depressions in the web, the depressions being provided in a pattern consistent with a pattern of tufting needles to be subsequently applied to the web;

(c) curing the elastomeric binder to obtain a cured web; and (d) contacting the cured web with tufting needles containing facing filaments to provide a tufted carpet backing.

14. The process of claim 13, wherein step (b) is accomplished by threading the web between at least two rollers, at least one roller having a smooth roller and at least one roller having a surface with raised protrusions.

15. The process of claim 14, wherein the nonwoven web is a spunbonded or spunlaid polyester and is needle-punched, heat-set and calendered prior to contact with the elastomeric binder.

* * * * *